US006349882B1

(12) United States Patent
Kita et al.

(10) Patent No.: US 6,349,882 B1
(45) Date of Patent: Feb. 26, 2002

(54) CONTROLLING DEVICE FOR HYDRAULICALLY OPERATED COOLING FAN

(75) Inventors: Ikuo Kita, Hirakata; Toshikazu Okada, Osaka; Atsushi Uemura, Hirakata; Shigeru Yamamoto, Hirakata; Tomohiro Nakagawa, Hirakata, all of (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/553,156

(22) Filed: Apr. 20, 2000

(30) Foreign Application Priority Data

Dec. 22, 1999 (JP) ..... 11-365696

(51) Int. Cl.[7] ..... F01P 7/02
(52) U.S. Cl. ..... 236/34
(58) Field of Search ..... 236/34, 100; 417/222.2; 123/41.12, 41.02, 41.49, 41.1, 41.01; 165/279

(56) References Cited

U.S. PATENT DOCUMENTS

| | | | | |
|---|---|---|---|---|
| 3,942,486 A | * | 3/1976 | Kirchner | |
| 4,062,329 A | * | 12/1977 | Rio | 123/41.12 |
| 4,200,146 A | * | 4/1980 | Olson | 165/279 |
| 4,446,697 A | * | 5/1984 | Goscenski, Jr. | 60/443 |
| 4,479,532 A | | 10/1984 | Watanabe | 165/39 |
| 4,798,177 A | | 1/1989 | Oomura et al. | 123/41.12 |
| 4,823,744 A | | 4/1989 | Omura | 123/41.12 |
| 4,890,666 A | * | 1/1990 | Clark | 165/208 |
| 5,165,377 A | | 11/1992 | Hosseini | 123/41.12 |
| 5,359,969 A | | 11/1994 | Dickrell et al. | 123/41.12 |
| 5,544,697 A | * | 8/1996 | Clark | 165/209 |
| 5,651,264 A | * | 7/1997 | Lo et al. | 62/230 |
| 5,799,869 A | * | 9/1998 | Pichotta | 237/8 A |
| 6,076,488 A | * | 6/2000 | Yamagishi | 123/41.12 |
| 6,126,079 A | * | 10/2000 | Shoemaker | 236/35 |
| 6,129,193 A | * | 10/2000 | Link | 192/84.1 |
| 6,190,126 B1 | * | 2/2001 | Haegele et al. | 416/31 |

FOREIGN PATENT DOCUMENTS

| | | |
|---|---|---|
| JP | 10-68142 | 3/1998 |
| JP | 11-365696 | 12/1999 |

* cited by examiner

*Primary Examiner*—Sang Paik
*Assistant Examiner*—Daniel Robinson
(74) *Attorney, Agent, or Firm*—Armstrong, Westerman, Hattori, McLeland & Naughton, LLP.

(57) ABSTRACT

A controlling device for a hydraulically operated cooling fan capable of obtaining optimum cooling efficiency by continuously controlling a rotational frequency of the cooling fan according to a cooling water temperature, a hydraulic oil temperature, and an engine speed is provided. To this end, the controlling device includes a hydraulic motor (16) for driving a cooling fan (13), a variable displacement hydraulic pump (14) capable of controlling the rotational frequency of the hydraulic motor (16), a cooling water temperature sensor (21) for detecting a cooling water temperature (TW), a hydraulic oil temperature sensor (22) for detecting a hydraulic oil temperature (To), an engine speed sensor (23) for detecting an engine speed (E), and a controller (20) which inputs detected signals from these sensors (21, 22, 23), computes and outputs a discharge capacity command value of the variable displacement hydraulic pump (14) according to the inputted cooling water temperature (Tw), hydraulic oil temperature (To), and engine speed (E), and continuously controls a rotational frequency (N) of the cooling fan (13) by means of the variable displacement hydraulic pump (14).

5 Claims, 7 Drawing Sheets

CONTROLLING DEVICE FOR HYDRAULICALLY OPERATED COOLING FAN

TECHNICAL FIELD

The present invention relates to a controlling device for a hydraulically operated cooling fan of construction equipment such as a bulldozer, hydraulic excavator, a wheel loader, and the like.

BACKGROUND ART

Generally, the use of cooling air blown from a cooling fan belt-driven by an engine is the widely used way of cooling the engine and a hydraulic equipment system of construction equipment. In this way, however, the rotational frequency of the cooling fan is proportional to the engine speed. Thus, cooling air is sent to a radiator and an oil cooler even when temperatures of engine cooling water, hydraulic oil, and the like do not reach a warming-up temperature appropriate for machine operation, for example, immediately after the starting of the engine. As a result, the cooling water and the hydraulic oil are supercooled, and more time is required for warming up.

As a prior art to settle the above disadvantage, a way of driving the cooling fan by means of an electric motor or a hydraulic motor the rotational frequency of which is controlled independently of engine rotation is known. As a prior art of a cooling system of construction equipment to which this way of cooling fan drive is applied, for example, a prior art disclosed in Japanese Patent Laid-open Bullctin No.10-68142 is given, and FIG. 13 shows a circuit diagram of a cooling system described in the above Bulletin.

In FIG. 13, a radiator 42*a* and an oil cooler 42*b* are disposed separately from an engine 41, and cooled by a cooling fan 45. The oil cooler 42*b* is disposed downstream of the radiator 42*a* with respect to air flow which arises during reverse rotation of the cooling fan 45. The cooling fan 45 is driven to stop, rotate normally, or rotate reversely by a hydraulic motor 48 controlled by a solenoid-controlled change-over valve 47 in a fan drive circuit 46. The solenoid-controlled change-over valve 47 is automatically switched by a controlling device 50 having an outside air temperature sensor 51, a cooling water temperature sensor 52, and a hydraulic oil temperature sensor 53. When all of an outside air temperature, a cooling water temperature, and a hydraulic oil temperature are lower than a set temperature at the starting of the engine, the controlling device 50 allows the rotation of the cooling fan 45 to remain stopped even if the engine 41 starts. Further, when the hydraulic oil temperature is lower than the set temperature although the cooling water temperature rises to the set temperature or more, the cooling fan 45 is reversed, whereby hydraulic oil in the oil cooler 42*b* is warmed up by warm air which has passed through the radiator 42*a* and dust which chokes the radiator 42*a* and the like is removed by against wind. Furthermore, when the cooling water temperature and the hydraulic oil temperature are not less than the set temperature, the cooling fan 45 is allowed to rotate normally to thereby cool cooling water and hydraulic oil.

It is described that as the result of the above, it becomes possible to shorten warming-up time of the hydraulic equipment and to improve cooling efficiency by removal of dust which chokes the radiator 42*a* and the oil cooler 42*b*.

In the art disclosed in the aforesaid Japanese Patent Laid-open No.10-68142, however, there arise the following disadvantages.

Normal rotation, stop, and reverse rotation of the cooling fan 45 are controlled according to the cooling water temperature, the hydraulic oil temperature, and the outside air temperature. But, the aforesaid control is ON-OFF control, so that fine control can not be provided, and thereby optimum cooling efficiency is not obtained. Further, the cooling fan 45 is not controlled depending on the load of the engine 41. Hence, when the load of the engine 41 changes, the rotational frequency of the cooling fan 45 also changes, whereby cooling at optimum efficiency according to the cooling water temperature, the hydraulic oil temperature, and the outside air temperature can not be provided.

SUMMARY OF THE INVENTION

In view of the aforesaid disadvantages, an object of the present invention is to provide a controlling device for a hydraulically operated cooling fan capable of obtaining optimum cooling efficiency by continuously controlling a rotational frequency of the cooling fan according to a cooling water temperature, a hydraulic oil temperature, and an engine speed.

A first configuration of a controlling device for a hydraulically operated cooling fan according to the present invention is characterized in that a controlling device for a hydraulically operated cooling fan in which a cooling system composed by forcedly cooling a radiator for cooling cooling water for an engine and an oil cooler for cooling, hydraulic oil for a hydraulic system by means of the cooling fan is provided independently of the engine, includes a hydraulic motor for driving the cooling fan, a variable displacement hydraulic pump capable of controlling a rotational frequency of the hydraulic motor, a cooling water temperature sensor for detecting, a cooling water temperature, a hydraulic oil temperature sensor for detecting a hydraulic oil temperature, an engine speed sensor for detecting an engine speed, and a controller which inputs detected signals from the cooling water temperature sensor, the hydraulic oil temperature sensor, and the engine speed sensor, computes and outputs a discharge capacity command value of the variable displacement hydraulic pump according to the inputted cooling water temperature, hydraulic oil temperature, and engine speed, and continuously controls a rotational frequency of the cooling fan by means of the variable displacement hydraulic pump.

According to the above configuration, the cooling fan rotational frequency is continuously controlled by the variable displacement hydraulic pump according to the cooling water temperature, the hydraulic oil temperature, and the engine speed, whereby the cooling fan rotational frequency is controlled smoothly without involving sharp change without being affected by rotational change of the engine. As a result, the cooling water temperature and the hydraulic oil temperature can be controlled finely, thus providing, optimum cooling efficiency.

The controlling device for the hydraulically operated cooling fan may have a configuration in which the controller controls an upper limit of the cooling fan rotational frequency at a predetermined rotational frequency irrespective of changes in the engine speed when the engine speed is not less than a predetermined engine speed.

According to the above configuration, the upper limit of the cooling fan rotational frequency is controlled at the predetermined rotational frequency irrespective of changes in the engine speed when the engine speed is not less than the predetermined engine speed. Accordingly, since the rotational frequency of the cooling fan is almost constant even if engine load increases and thereby the engine speed decreases, cooling capacity does not lower. Moreover, the rotational frequency of the cooling fan is almost constant even if the engine load decreases and thereby the engine speed increases, thereby not causing supercooling and unnecessary consumption of energy, which enables efficient cooling. Generally, as for the cooling fan, when the rotational frequency thereof exceeds some rotational frequency level, a produced sound abruptly increases, but an increase in cooling capacity corresponding to an increase in fan drive energy is not given. Meanwhile, according to the configuration of the present invention, the rotation of the fan at excessively high speed such as described above can be avoided, thus enabling efficient cooling from the viewpoint of noise reduction of the cooling fan and fan drive energy, and further serving the prevention of breakage of the cooling fan.

Further, the controlling device for the hydraulically operated cooling fan may have a configuration in which the upper limit of the cooling fan rotational frequency is set according to the cooling water temperature and the hydraulic oil temperature.

Owing to the above configuration, the cooling fan is driven at a nearly constant rotational frequency based on the cooling water temperature and the hydraulic oil temperature, irrespective of changes in the engine speed. Therefore, without causing insufficient cooling or supercooling, efficient cooling becomes possible.

Furthermore, the controlling device for the hydraulically operated cooling fan may have a configuration in which the controller controls the cooling fan rotational frequency at a predetermined low speed rotational frequency when the cooling water temperature and the hydraulic oil temperature are not more than a predetermined low temperature.

According to the above configuration, when the cooling water temperature and the hydraulic oil temperature are not more than the predetermined low temperature, the cooling fan rotational frequency is controlled at the predetermined low speed rotational frequency which is at the level of no cooling capacity. Thus, a very small amount of hydraulic oil is always circulated in the oil cooler in the state of the low temperature, thereby preventing supercooling of the temperature of the hydraulic oil. Further, the hydraulic pump for the cooling fan discharges and circulates a small amount of oil, thereby preventing the pump from overheating and seizing up.

A second configuration of a controlling device for a hydraulically operated cooling fan according to the present invention is characterized in that a controlling device for a hydraulically operated cooling fan in which a cooling system composed by forcedly cooling a radiator for cooling cooling water for an engine and an oil cooler for cooling hydraulic oil for a hydraulic system by means of the cooling fan is provided independently of the engine, includes a hydraulic motor for driving the cooling fan, a variable displacement hydraulic pump capable of controlling a rotational frequency of the hydraulic motor, a limit switch for setting an upper limit rotational frequency of the cooling fan, and a controller which inputs a signal from the limit switch, outputs a command value to limit a discharge capacity of the variable displacement hydraulic pump to not more than a predetermined value when the inputted signal is a limit signal, and controls a rotational frequency of the cooling fan at not more than a predetermined limited rotational frequency.

According to the above configuration, the rotational frequency of the cooling fan can be controlled at not more than the predetermined limited rotational frequency by the limit switch, thereby reducing the upper limit rotational frequency of the cooling fan as the occasion demands in the case of operations in a city area, which makes it possible to reduce noise to comply with the request of a working site and to easily cope with noise regulation. Moreover, engine output to the cooling fan can be limited by the limit switch, whereby engine output can be effectively utilized for the vehicle body and the working machine according to the load of the engine.

A third configuration of a controlling device for a hydraulically operated cooling fan according to the present invention is characterized in that a controlling device for a hydraulically operated cooling fan in which a cooling system composed by forcedly cooling a radiator for cooling cooling water for an engine and an oil cooler for cooling hydraulic oil for a hydraulic system by means of the cooling fan is provided independently of the engine, includes a hydraulic motor for driving the cooling fan, a hydraulic pump for driving the hydraulic motor, a cooling water temperature sensor for detecting a cooling water temperature, a hydraulic oil temperature sensor for detecting a hydraulic oil temperature, an engine speed sensor for detecting an engine speed, and a controller which inputs detected signals from the cooling water temperature sensor, the hydraulic oil temperature sensor, and the engine speed sensor, computes an upper limit value of a rotational frequency of the cooling fan based on the inputted detected signals, and controls the rotational frequency of the cooling fan by the computed upper limit value.

According to the above configuration, the upper limit value of the rotational frequency of the cooling fan is set according to the cooling water temperature, the hydraulic oil temperature, and the engine speed, and the cooling fan rotational frequency is controlled based on the upper limit value via the hydraulic motor, whereby the cooling fan rotational frequency is controlled continuously without being affected by rotational change of the engine and without involving sharp change. As a result, the cooling water temperature and the hydraulic oil temperature can be controlled finely, thus providing optimum cooling efficiency. Moreover, since the upper limit value of the cooling fan rotational frequency is set according to the cooling water temperature and the hydraulic oil temperature, the cooling fan is driven at an almost constant rotational frequency based on the cooling water temperature and the hydraulic oil temperature, irrespective of changes in engine speed. Consequently, without causing insufficient cooling or supercooling, efficient cooling becomes possible.

BEST MODE FOR CARRYING OUT THE INVENTION

A preferred embodiment of the present invention will be described in detail below with reference to the attached drawings.

Figure 1:
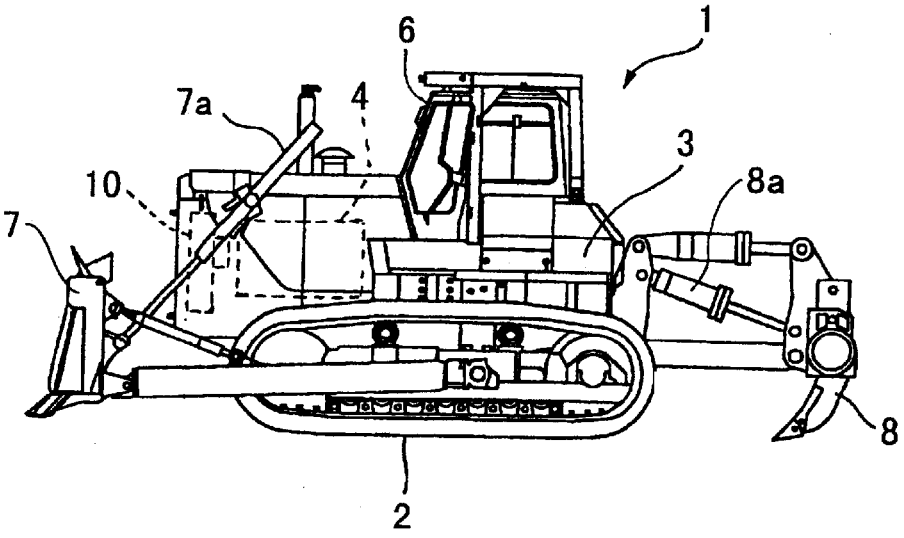
FIG. 1 is a side view of a bulldozer as an example of construction equipment to which the present invention is applied.

First, a bulldozer 1 as an example of construction equipment to which the present invention is applied will be explained in outline by means of FIGS. 1 and 2. FIG. 1 is a side view of the bulldozer 1, and FIG. 2 is a top view of a portion around a cooling fan 13.

As shown in FIG. 1, the bulldozer 1 includes a lower structure 2 which can travel freely at the lower part thereof and a vehicle body 3 on the top of the lower structure 2. An engine 4 and a cooling system 10 including a radiator 11, a cooling fan 13, and the like are mounted in an engine room provided at the front of the vehicle body 3. A driver's cab 6 is located at the center of but slightly to the rear of the vehicle body 3. A blade 7 and a ripper 8 as working machines are attached respectively to the front and the rear portion of the vehicle body 3, and they are movable vertically by means of hydraulic cylinders 7*a,* 8*a,* and the like. These hydraulic cylinders 7*a,* 8*a,* and the like are driven by pressure oil from a hydraulic system not illustrated.

Figure 2:
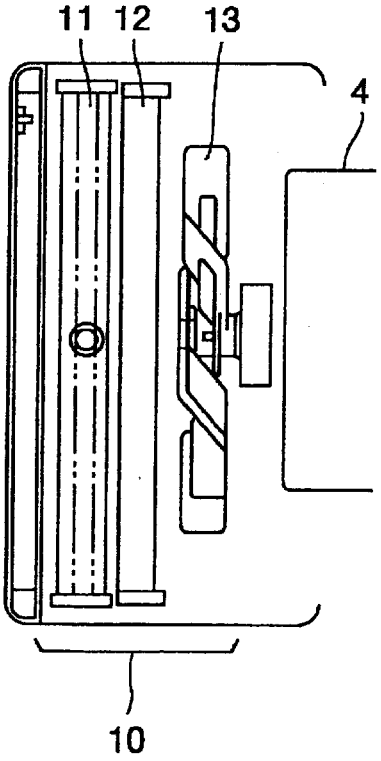
FIG. 2 is a top view of a portion around a cooling fan of the bulldozer in FIG. 1.

As shown in detail in FIG. 2, the cooling system 10 is disposed in front of the engine 4 and includes the radiator 11 for cooling cooling water for the engine 4, an oil cooler 12 for cooling hydraulic oil for the aforesaid hydraulic system not illustrated, and a cooling fan 13, driven independently of the rotation of the engine 4, for sending cooling air to the radiator 11 and the oil cooler 12.

Figure 3:
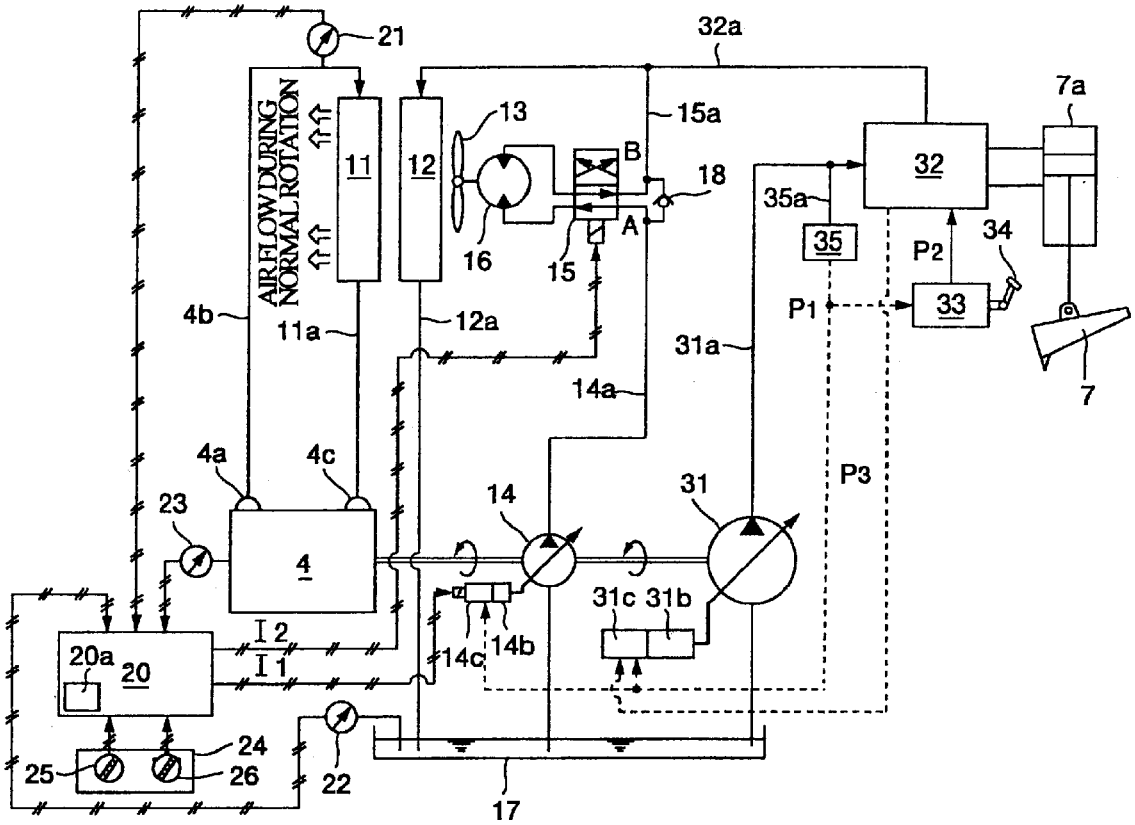
FIG. 3 is a circuit diagram of a hydraulically operated cooling fan controlling device according to an embodiment of the present invention.

Next, a drive system of the cooling fan 13 will be explained by means of FIG. 3. FIG. 3 is a circuit diagram of a cooling fan controlling device.

As shown in FIG. 3, the engine 4 drives variable displacement hydraulic pumps 14 and 31. Pressure oil discharged from the hydraulic pump 14 flows in an input port of a solenoid-controlled change-over valve 15 through a line 14*a,* and it is supplied to a fixed displacement hydraulic motor 16 by means of the solenoid-controlled change-over valve 15. The cooling fan 13 is rotatably attached to an output rotating shaft of the hydraulic motor 16. Return oil from the hydraulic motor 16 flows in the oil cooler 12 via the solenoid-controlled change-over valve 15, a line 15*a,* and a line 32*a,* and returns to a hydraulic oil tank 17 through a line 12*a* after being cooled in the oil cooler 12. Thus, a circuit of oil is formed. Connected to a point between the line 14*a* and the line 15*a* is a check valve 18 for circulating oil from the hydraulic motor 16 being rotated by inertia while the hydraulic pump 14 and the hydraulic motor 16 are stopped.

A hydraulic oil temperature sensor 22 for detecting the temperature of hydraulic oil is provided in the hydraulic tank 17, and a detected temperature signal therefrom is inputted to a controller 20.

The output capacity of the hydraulic pump 14 is controlled by the operation of a servo valve 14*b,* thereby changing the discharge amount thereof. The rotational frequency of the cooling fan 13 is controlled by this variable discharge amount. Upon receipt of a control pressure p1 from a pressure reducing valve 35 in a working machine circuit which will be described later, a solenoid-controlled proportioning valve 14*c* outputs a pilot pressure corresponding to a command current value I1 from the controller 20 to the servo valve 14*b*. The servo valve 14*b* controls the tilt angle of the hydraulic pump 14 based on this pilot pressure. The solenoid-controlled change-over valve 15 is a two position valve, and switches from/to a position A to/from a position B in response to a current command 12 from the controller 20 to control the output flow rate and direction thereof, thereby controlling normal rotation and reverse rotation of the hydraulic motor 16, that is, the cooling fan 13.

The variable displacement hydraulic pump 31 which is used for the working machine shown in FIG. 1 (The blade 7 is taken here as representation.) is driven by the engine 4. Pressure oil discharged from the hydraulic pump 31 flows in a control valve 32 via a line 31*a,* and it is supplied to the hydraulic cylinder 7*a* by operation of the control valve 32. Vertical motion of the blade 7 is driven by extension and contraction of the hydraulic cylinder 7*a*. Return oil from the hydraulic cylinder 7*a* flows in the oil cooler 12 via the control valve 32 and the line 32*a,* and it is cooled in the oil cooler 12, and returns to the hydraulic oil tank 17 through the line 12*a,* thus forming a circulation circuit.

Upon receipt of the control pressure p1 from the pressure reducing valve 35 provided diverging from the line 31*a,* a pilot pressure control valve 33 outputs a pilot pressure p2 corresponding to the manipulated variable of an operating lever 34. The control valve 32 supplies discharge oil to the amount corresponding to the pilot pressure p2 from the pilot pressure control valve 33. The discharge amount of the hydraulic pump 31 is controlled by the operation of a servo valve 31*b,* and the speed of the hydraulic cylinder 7*a* is controlled by the above variable discharge amount.

Upon receipt of a load pressure p3 from the control valve 32 and the control pressure p1 from the pressure reducing valve 35, the load sensing valve (LS valve) 31*c* outputs a pilot pressure to the servo valve 31*b*. The servo valve 31*b* controls the tilt angle of the hydraulic pump 31 based on this pilot pressure.

Cooling water from a water pump 4*a* of the engine 4 flows in the radiator 11 through a line 4*b*, and it is cooled in the radiator 11 and returns to a water jacket 4*c* of the engine 4 through a line 11*a*, thereby forming a circulation circuit. An engine speed sensor 23 for detecting engine speed is provided in the engine 4, and a cooling water temperature sensor 21 for detecting the temperature of engine cooling water is provided in the inlet line 4*b* of the radiator 11. Respective detected signals by the sensors 23 and 21 are inputted to the controller 20.

Provided on an operating panel 24 are a limit switch 25 for switching a set value of the upper limit rotational frequency of the cooling fan 13 and a change-over switch 26 for switching the solenoid-controlled change-over valve 15, and respective switch signals are inputted to the controller 20.

The controller 20 is mainly composed of a processing unit such as a microcomputer, a numerical arithmetic processor, or the like, and has a storage section 20*a* for storing control data and the like. The controller 20 carries out predetermined computing processing based on respective signals detected by the aforesaid cooling water temperature sensor 21, hydraulic oil temperature sensor 22, and the engine speed sensor 23, and ON-OFF signals by the limit switch 25. The controller 20 finds a command current value 11 for commanding the rotational frequency of the cooling fan 13 by means of the computing processing and outputs the command current value 11 to the solenoid-controlled proportioning valve 14*c*. Moreover, the controller 20 outputs the current command 12 for switching to the solenoid-controlled change-over valve 15 based on the switch signal to normal rotation or reverse rotation by the change-over switch 26.

Next, the controller 20 will be explained based on FIG. 4 to FIG. 9.

Target fan rotational frequencies with respect to various kinds of detected values and set values are stored in the storage section 20*a* in the form of data (for example, in the form of "diagrams"), for example, such as shown in FIG. 4 to FIG. 8. These data are previously drawn up based on experiments and the like and inputted.

Figure 4:
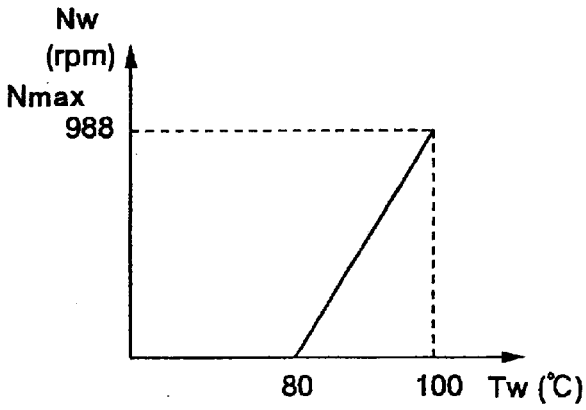
FIG. 4 is a relation diagram of a cooling water temperature and a target fan rotational frequency according to the embodiment of the present invention.
Figure 5:
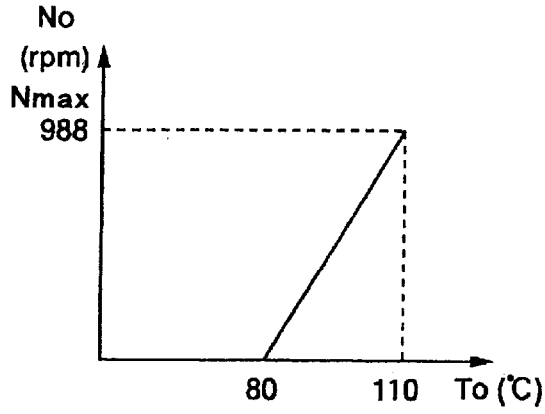
FIG. 5 is a relation diagram of a hydraulic oil temperature and a target fan rotational frequency according to the embodiment of the present invention.
Figure 6:
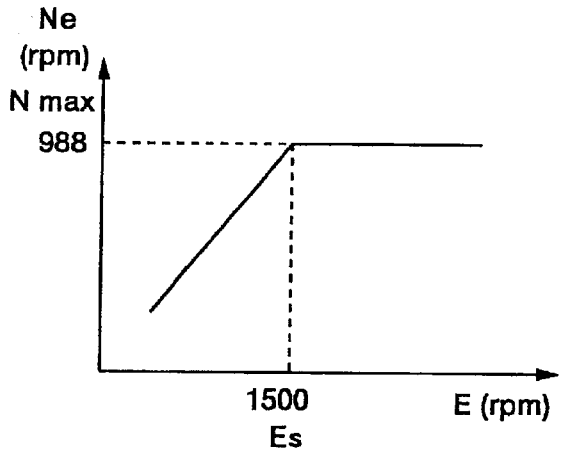
FIG. 6 is a relation diagram of an engine speed and an upper limit target fan rotational frequency according to the embodiment of the present invention.
Figure 7:
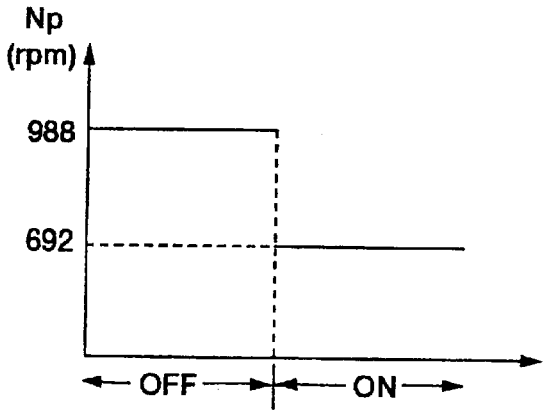
FIG. 7 is a diagram showing an example of a target fan rotational frequency Np when a limit switch is on and off according to the embodiment of the present invention.
Figure 8:
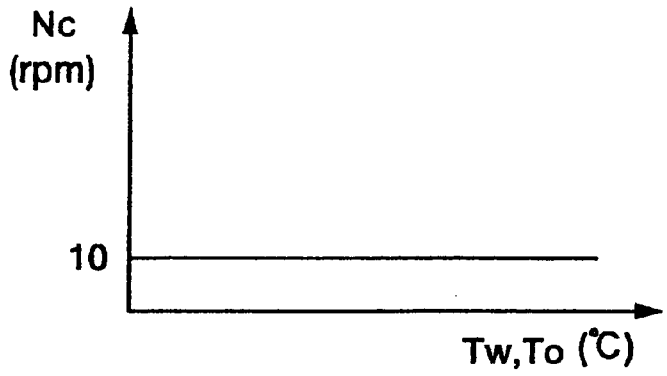
FIG. 8 is a diagram showing an example of a target fan rotational frequency when the cooling water temperature and the hydraulic oil temperature are not more than a predetermined low temperature according to the embodiment of the present invention.
Figure 9:
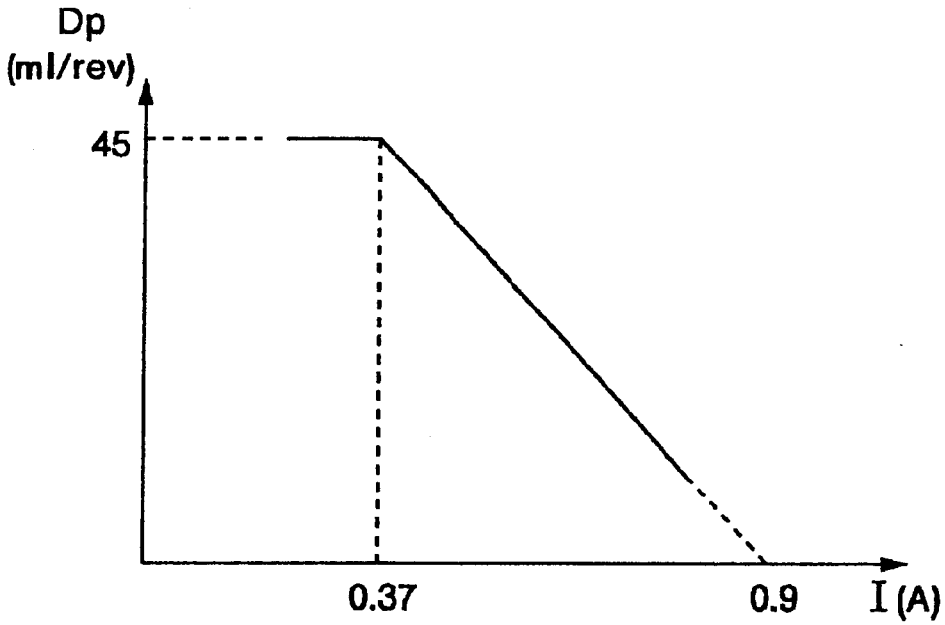
FIG. 9 is a relation diagram of a target pump capacity and a current value to a solenoid-controlled proportioning valve according to the embodiment of the present invention.

FIG. 4 shows an example of the relation between a cooling water temperature Tw and a target fan rotational frequency Nw, FIG. 5 shows an example of the relation between a hydraulic oil temperature To and a target fan rotational frequency No, and FIG. 6 shows an example of the relation between an engine speed E and an upper limit target fan rotational frequency Ne. FIG. 7 shows an example of a target fan rotational frequency Np when the limit switch is on or off, and FIG. 8 shows an example of a target fan rotational frequency Nc when the cooling water temperature Tw and the hydraulic oil temperature To are not more than a predetermined low temperature Tc. FIG. 9 shows an example of the relation diagram of a target pump capacity Dp and the command current value I1 to the solenoid-controlled proportioning valve 14*c*. Each of these data is stored as table data or a predetermined relational expression.

Figure 10:
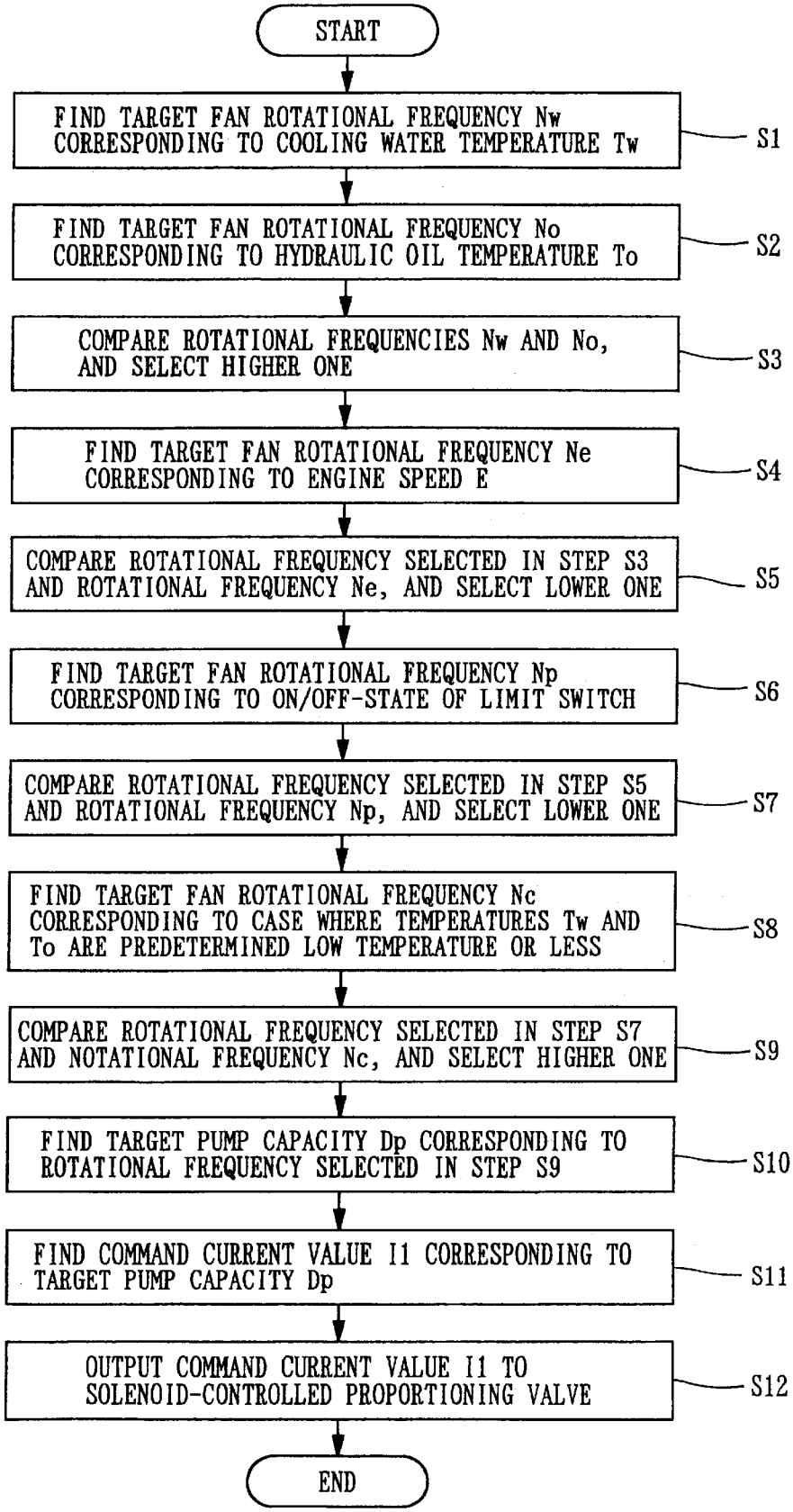
FIG. 10 shows a control flowchart example according to the embodiment of the present invention.

Next, a control sequence will be explained based on a control flowchart example of the controller 20 shown in FIG. 10.

(1) In step S1, the target fan rotational frequency Nw corresponding to the cooling water temperature Tw inputted from the cooling water temperature sensor 21 is derived, for example, based on such a table as shown in FIG. 4 or the like.

(2) In step S2, the target fan rotational frequency No corresponding to the hydraulic oil temperature To inputted from the hydraulic oil temperature sensor 22 is derived, for example, based on such a table as shown in FIG. 5 or the like.

(3) In step S3, the derived target fan rotational frequency Nw and target fan rotational frequency No are compared, and the higher rotational frequency is selected.

(4) In step S4, the target fan rotational frequency Ne corresponding to the engine speed E inputted from the engine speed sensor 23 is derived, for example, based on such a table as shown in FIG. 6 or the like.

(5) In step S5, the higher rotational frequency out of the target fan rotational frequency Nw and the target fan rotational frequency No which is given in step S3 and the target fan rotational frequency Ne given in step S4 are compared, and the lower rotational frequency is selected.

(6) In step S6, the target fan rotational frequency Np corresponding to an ON-signal or an OFF-signal of the limit switch 25 is derived, for example, based on such a table as shown in FIG. 7 or the like.

(7) In step S7, the rotational frequency selected in step S5 and the target fan rotational frequency Np derived in step S6 are compared, and the lower rotational frequency is selected.

(8) In step S8, the target fan rotational frequency Nc corresponding to the case where a temperature to be controlled (the higher temperature out of the cooling water temperature Tw and the hydraulic oil temperature To) is not more than the predetermined low temperature Tc is obtained, for example, based on such a table as shown in FIG. 8.

(9) In step S9, the lower rotational frequency derived in step S7 and the target fan rotational frequency Nc obtained in step S8 are compared, and the higher rotational frequency is selected as a final target fan rotational frequency N.

(10) In step S10, the target pump capacity Dp (ml/rev) corresponding to the target fan rotational frequency N selected in step S9 is calculated by the the following expression 1 based on the target fan rotational frequency N (rpm) and the engine speed E (rpm) at that time.

$$Dp=N\times Dm/(E\times\rho) \qquad \text{(Expression 1)}$$

where Dm (ml/rev) is a fixed capacity of the hydraulic motor 16 and ρ is the reduction ratio of the engine 4 to the hydraulic pump 14.

(11) In step S11, the command current value I1 to the solenoid-controlled proportioning valve 14*c* corresponding to the target pump capacity Dp obtained in step S10 is derived based on such a table as shown in FIG. 9.

(12) In step 12, the command current value I1 derived in step S11 is outputted from the controller 20 to the solenoid-controlled proportioning valve 14*c*.

Thus, the cooling fan rotational frequency N is controlled at any one of the target fan rotational frequencies Nw, No, Ne, Np,, and Nc depending on conditions of the cooling water temperature Tw, the hydraulic oil temperature To, the engine speed E, and the limit switch 25.

The controller 20 outputs the current command I2 based on a switch signal to normal rotation or reverse rotation by the change-over switch 26 to thereby control normal rotation or reverse rotation of the cooling fan 13.

Figure 11:
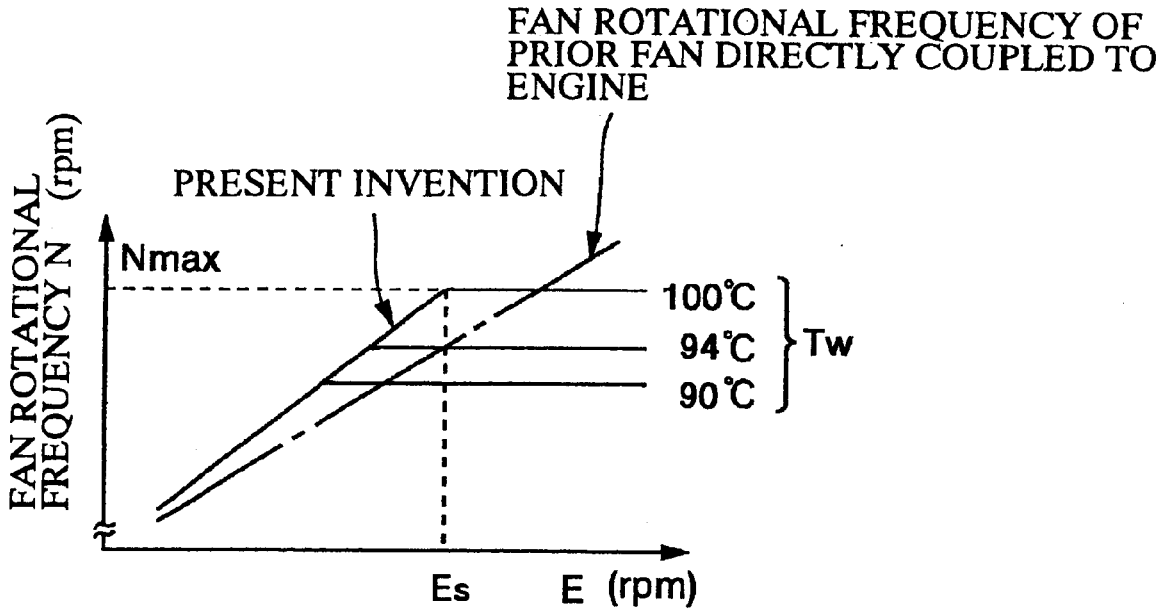
FIG. 11 is a diagram showing the relation between an engine speed and a fan rotational frequency at some cooling water temperature levels in the embodiment of the present invention.
Figure 12:
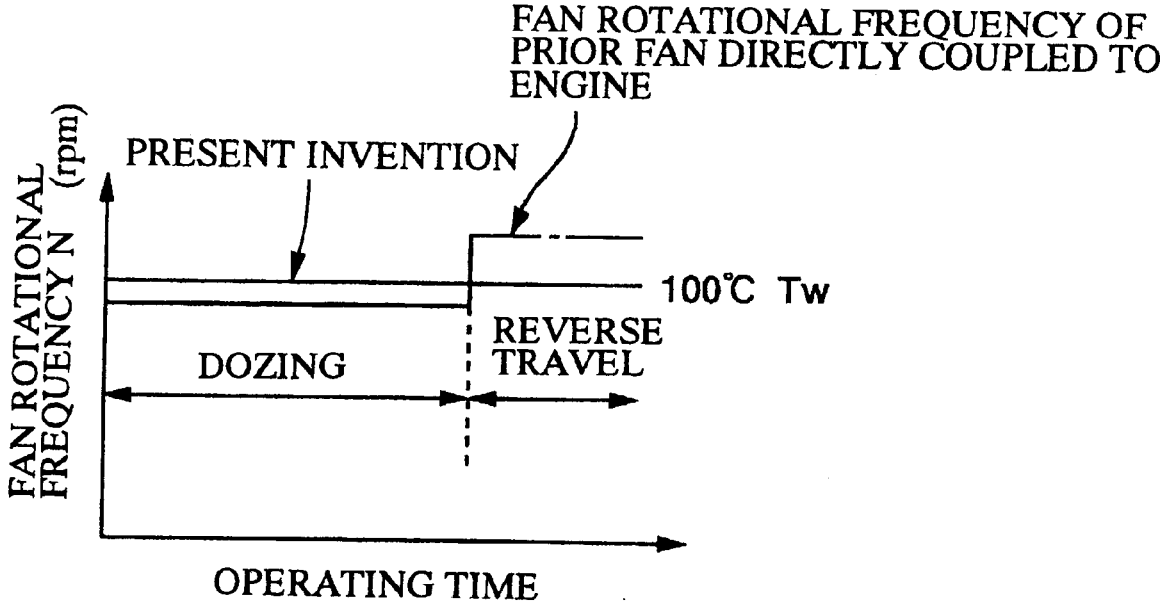
FIG. 12 is a diagram showing a cooling fan rotational frequency corresponding to a loaded condition of a working machine in the embodiment of the present invention and a prior art.
Figure 13:
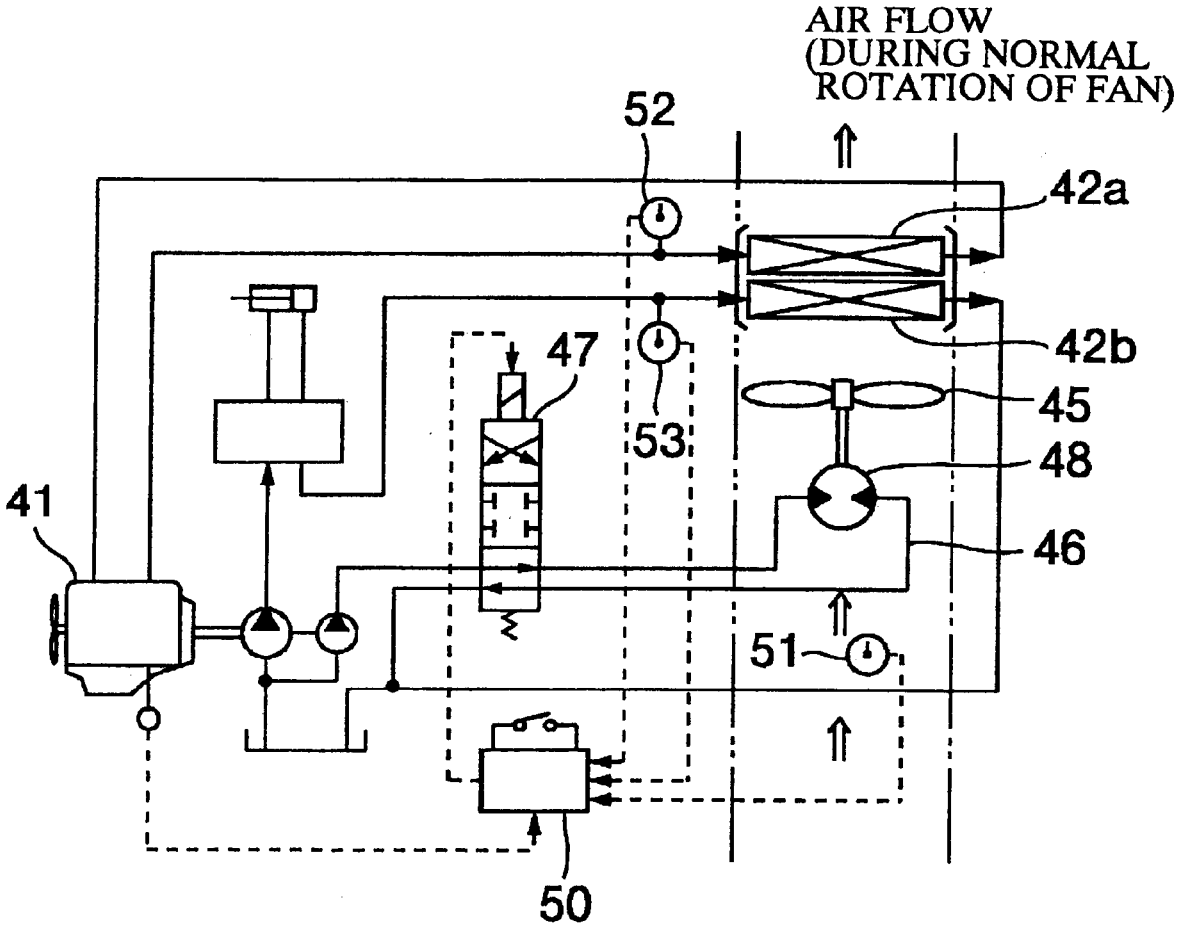
FIG. 13 PRIOR ART
FIG. 13 is a circuit diagram of a cooling system according to the prior art.

Next, operation and effects will be explained by means of FIG. 10 to FIG. 12 with reference to FIG. 4 to FIG. 8. FIG. 11 is a relation diagram of the engine speed E and the fan rotational frequency N with respect to the cooling water temperature Tw. FIG. 12 is a diagram showing a cooling fan rotational frequency corresponding to a loaded condition of the working machine, and the fan rotational frequency N is shown with earth-moving operations (so-called dosing operations) by means of the blade 7 as an example in FIG. 12.

(1) The cooling water temperature Tw or the hydraulic oil temperature To, which corresponds to the higher rotational frequency out of the target fan rotational frequencies Nw and No, is selected as a temperature to be controlled in step S3. As a result, a target rotational frequency of the cooling fan 13 is set so that both the cooling water temperature Tw and the hydraulic oil temperature To are a predetermined value or less. Thereby, the cooling water temperature Tw and the hydraulic oil temperature To can be controlled simultaneously at not more than the predetermined value by controlling the rotational frequency of the cooling fan 13.

(2) As shown in FIG. 4, the target fan rotational frequency Nw with respect to the cooling water temperature Tw is set so as to increase almost linearly from zero to a maximum rotational frequency Nmax in a predetermined water temperature control range (a minimum temperature 80° C. to a maximum temperature 100° C. in this example). Moreover, as shown in FIG. 5, the target fan rotational frequency No with respect to the hydraulic oil temperature To is set so as to increase almost linearly from zero to the maximum rotational frequency Nmax in a predetermined hydraulic oil temperature control range (a minimum temperature 80° C. to a maximum temperature 110° C. in this example). Meanwhile, as shown in FIG. 6, the target fan rotational frequency Ne with respect to the engine speed E increases almost linearly to the maximum rotational frequency Nmax as far as a predetermine engine speed Es (1500 rpm in this example), and it is limited to the maximum rotational frequency Nmax in a range beyond the predetermined engine speed Es.

It is assumed here that the limit switch 25 is off, and that the cooling water temperature Tw and the hydraulic oil temperature To are respectively within the predetermined control ranges (in the state of normal operation). In this assumption, the higher one out of the target fan rotational frequency Nw and the target fan rotational frequency No, which is selected in step S3, has a value smaller than the target fan rotational frequency Ne derived from the engine speed E when the engine speed E is not less than the predetermined engine speed Es, whereby it is selected as "the lower rotational frequency" in step S5. Further, the aforesaid "higher one out of the target fan rotational frequencies Nw and No" is set at a value smaller than the target fan rotational frequency Np (988 rpm as shown in FIG. 7 in this example) corresponding to the state in which the limit switch 25 is off, whereby it is selected as "the lower rotational frequency" in step S7. Furthermore, when the temperature to be controlled (the higher one out of the cooling water temperature Tw and the hydraulic oil temperature To) is not more than the predetermined low temperature Tc (80° C. in this example), the aforesaid "higher one out of the target fan rotational frequencies Nw and No" is higher than the target fan rotational frequency Nc (10 rpm as shown in FIG. 8 in this example) in a range not more than the predetermined low temperature Tc, whereby it is selected as the final target fan rotational frequency N in step S9.

Accordingly, the upper limit value of the target fan rotational frequency N when the engine speed E is not less than the predetermined engine speed Es is set and controlled at the target fan rotational frequency Nw corresponding to the cooling water temperature Tw as shown in FIG. 11 or the target fan rotational frequency No corresponding to the hydraulic oil temperature To similarly to FIG. 11. Incidentally, when the engine speed E is less than the predetermined engine speed Es, the target fan rotational frequency Ne derived from the engine speed E is lower than the higher one out of the target fan rotational frequencies Nw and No which is selected in step S3, whereby the target fan rotational frequency Ne is set.

In other words, as shown in FIG. 6, the upper limit target fan rotational frequency Ne is previously set with respect to the engine speed E in the cooling fan 13. Hence, even when the cooling water temperature Tw and the hydraulic oil temperature To increase gradually and thereby the target fan rotational frequency Nw or the target fan rotational frequency No selected in step S3 reaches the maximum target rotational frequency Nmax (988 rpm in this example), the aforesaid upper limit target fan rotational frequency Ne is set to be lower than this maximum target rotational frequency Nmax when the engine speed E is less than the predetermined engine speed Es. Therefore, even if the cooling water temperature Tw or the hydraulic oil temperature To reaches a predetermined maximum temperature, the upper limit target fan rotational frequency Ne is selected in step S5 when the engine speed E is less than the predetermined engine speed Es (Es=1500 rpm in this example). This upper limit target fan rotational frequency Ne is set at a value smaller than the target fan rotational frequency Np (988 rpm in this example) corresponding to the state in which the limit switch 25 is off, and thereby selected in step S7. Further, the upper limit target fan rotational frequency Ne is higher than the target fan rotational frequency Nc corresponding to the case where the temperature to be controlled is not more than the predetermined low temperature Tc, and thereby selected as the final target fan rotational frequency N in step S9.

Thus, the target fan rotational frequency N is set and controlled at the upper limit target rotational frequency Ne when the cooling water temperature Tw or the hydraulic oil temperature To reaches the predetermined maximum temperature and the engine speed is less than the predetermined engine speed Es.

Namely, when the cooling water temperature Tw is used as a parameter, the target fan rotational frequency N is limited to the target fan rotational frequency N corresponding to the cooling water temperature Tw (or the hydraulic oil temperature To) as shown in FIG. 11 until the cooling water temperature Tw (or the hydraulic oil temperature To) reaches the predetermined maximum temperature. When the cooling water temperature Tw (or the hydraulic oil temperature To) reaches the predetermined maximum temperature, the target fan rotational frequency N is limited to the upper limit target fan rotational frequency Ne if the engine speed E is less than the predetermined engine speed Es. Even if the hydraulic oil temperature To is used as a parameter (as described in the aforesaid parentheses), the fan rotational frequency N is limited as in the case of the cooling water temperature Tw.

Thus, the fan rotational frequency N is controlled continuously and smoothly at a necessary and sufficient rotational frequency in order to avoid supercooling. Hence, the cooling water temperature Tw and the hydraulic oil temperature To can be minutely controlled, thereby obtaining optimum cooling efficiency.

(3) When the engine speed E is not less than the predetermined engine speed Es, the target fan rotational frequency corresponding to the cooling water temperature Tw or the hydraulic oil temperature To is set to be less than the upper limit target fan rotational frequency Ne. In this range, the fan rotational frequency N is controlled at the predetermined target rotational frequency or less according to the cooling water temperature Tw or the hydraulic oil temperature To, irrespective of changes in the engine speed E. Therefore, even if engine load increases and thereby the engine speed E decreases, or even if engine load decreases and thereby the engine speed E increases, the fan rotational frequency N is controlled almost invariably. Thus, as shown in FIG. 12, even during operations composed of a combination of earth-moving operations (so-called dozing operations) by the blade 7 and vehicle reverse travel, for example, the fan rotational frequency N is controlled almost invariably, thereby not causing a lowering of cooling capacity and unnecessary consumption of energy due to supercooling and enabling efficient cooling. Further, control is performed so that the fan does not rotate at excessively high speed, thereby enabling, noise reduction of the cooling fan 13 and efficient cooling such as can provide an increase in cooling capacity corresponding to an increase in fan drive energy, and further preventing breakage of the cooling fan 13.

Moreover, the cooling fan 13 is not rotated more than necessary and sufficient, which makes it possible to reduce load of the engine 4 and to afford more power to engine output necessary for operations by means of the working machine. As a result, workability in the state of high load can be improved as compared with the prior art.

(4) As shown in FIG. 4 and FIG. 5, when the cooling water temperature Tw and the hydraulic oil temperature To are not more than the predetermined low temperature Tc (80° C. in this example), the target fan rotational frequencies Nw and No are set at 0 rpm. Hence, the target fan rotational frequency Nw and the target fan rotational frequency No are selected in step S5 and step S7 in FIG. 10, but the target fan rotational frequency Nc is selected in step S9. Thus, the fan rotational frequency N is controlled at the target fan rotational frequency Nc which is low speed rotation at a level of no cooling capacity. Accordingly, in the case of not more than the predetermined temperature Tc, a very small amount of hydraulic oil is always circulated in the oil cooler 12 without being stopped, thereby preventing supercooling of the temperature of the hydraulic oil. Further, the hydraulic pump 14 for the cooling fan 13 discharges and circulates a small amount of oil in this situation, thereby preventing the hydraulic pump 14 from overheating and seizing up.

(5) When the limit switch 25 is on, the target fan rotational frequency Np (692 rpm in FIG. 7) corresponding to "on" is set as shown in FIG. 7. Thus, the engine speed E increases, and the upper limit target fan rotational frequency Ne, the target fan rotational frequency Nw, or the target fan rotational frequency No corresponding to this engine speed E exceeds the target fan rotational frequency Np, the target fan rotational frequency Np is selected in step S7 and step S9, whereby the upper limit of the fan rotational frequency N is limited to and controlled at the target fan rotational frequency Np. Consequently, in the case of operations in a city area, by operating the limit switch 25 in an "on"-state and reducing the upper limit rotational frequency of the cooling fan 13 as the occasion demands, it becomes possible to reduce noise and to easily cope with noise regulation. For example, it is possible that the target fan rotational frequency Np is set at 70% of the maximum rotational frequency Nmax so that noise in this situation does not surpass a regulation value. Moreover, driving output of the cooling fan 13 can be limited by operating the limit switch 25 to the "on"-state, whereby engine output can be effectively utilized for the vehicle body and the working machine according to required load of the engine 4.

(6) The rotation of the cooling fan 13 can be reversed by changing over the change-over switch 26 to a reverse rotation position, whereby dust and the like which choke the radiator 11 and the oil cooler 12 can be discharged. Consequently, cleaning is facilitated and cooling capacity can be held constant.

Incidentally, although the rotational frequency control of the cooling fan 13 is carried out by controlling the discharge amount of the variable displacement hydraulic pump 14 which drives the hydraulic motor 16 in the aforesaid embodiment, the present invention is not limited to this example. For example, it is suitable to control the capacity of a variable displacement hydraulic motor by the use of a fixed displacement hydraulic pump and the variable displacement hydraulic motor.

As explained above, according to the hydraulically operated cooling fan according to the present invention, even if the engine speed changes with an change in load in the engine, the cooling fan is controlled at a constant rotational frequency according to the cooling water temperature and the hydraulic oil temperature, thereby not causing a lowering of cooling capacity and unnecessary consumption of energy and enabling efficient cooling.

Further, the cooling fan rotational frequency is controlled continuously and smoothly at not more than a predetermined value according to the cooling water temperature and the hydraulic oil temperature, whereby as compared with the prior art, changes in rotational frequency can be controlled minutely and precisely and hence optimum cooling efficiency can be obtained. In addition, more power can be afforded to engine output, and thus engine output can be effectively utilized for the vehicle body and the working machine.

In the case of low temperature, the cooling fan is controlled at a low speed rotational frequency with small cooling capacity, thereby preventing supercooling of cooling water and hydraulic oil without using expensive equipment such as a radiator shutter.

The upper limit target rotational frequency of the cooling fan can be decreased according to circumstances so as to comply with the request of a working site, which makes it possible to reduce noise and to easily cope with noise regulation. Besides, the cooling fan can be reversely rotated by the rotation direction change-over switch, whereby dust and the like which choke the radiator and the oil cooler can be easily discharged without using an expensive reversible fan.

What is claimed is:

1. A controlling device for a hydraulically operated cooling fan in which a cooling system composed by forcedly cooling a radiator for cooling water for an engine and an oil cooler for cooling hydraulic oil for a hydraulic system by means of said cooling fan is provided independently of said engine, comprising:

a hydraulic motor for driving said cooling fan;

a variable displacement hydraulic pump capable of controlling a rotational frequency of said hydraulic motor;

a cooling water temperature sensor for detecting a cooling water temperature;

a hydraulic oil temperature sensor for detecting a hydraulic oil temperature;

an engine speed sensor for detecting an engine speed; and a controller which inputs detected signals from said cooling water temperature sensor, said hydraulic oil temperature sensor, and said engine speed sensor, computes and outputs a discharge capacity command value of said variable displacement hydraulic pump and an upper and/or lower limit value of a rotational frequency of said cooling fan according to the inputted cooling water temperature, hydraulic oil temperature, and engine speed, and continuously controls a rotational frequency of said cooling fan by means of said variable displacement hydraulic pump.

2. The controlling device for the hydraulically operated cooling fan in accordance with claim 1, wherein said controller controls an upper limit of said cooling fan rotational frequency at a predetermined rotational frequency irrespective of changes in said engine speed when said engine speed is not less than a predetermined engine speed.

3. The controlling device for the hydraulically operated cooling fan in accordance with claim 2, wherein the upper limit of said cooling fan rotational frequency is set according to said cooling water temperature and said hydraulic oil temperature.

4. The controlling device for the hydraulically operated cooling fan in accordance with claim 1, wherein said controller controls said cooling fan rotational frequency at a predetermined low speed rotational frequency when said cooling water temperature and said hydraulic oil temperature are not more than a predetermined low temperature.

5. A controlling device for a hydraulically operated cooling fan in which a cooling system composed by forcedly cooling a radiator for cooling cooling water for an engine and an oil cooler for cooling hydraulic oil for a hydraulic system by means of said cooling fan is provided independently of said engine, comprising:

a hydraulic motor for driving said cooling fan;

a variable displacement hydraulic pump capable of controlling a rotational frequency of said hydraulic motor;

a limit switch for setting an upper limit rotational frequency of said cooling fan; and a controller which inputs a signal from said limit switch, outputs a command value to limit a discharge capacity of said variable displacement hydraulic pump to not more than a predetermined value when said inputted signal is a limit signal, and controls a rotational frequency of said cooling fan at not more than a predetermined limited rotational frequency.

* * * * *